United States Patent [19]

Eskelinen et al.

[11] Patent Number: 4,516,330

[45] Date of Patent: May 14, 1985

[54] METHOD AND APPARATUS FOR THE DRYING SECTION OF A PAPER MACHINE

[75] Inventors: Pekka Eskelinen; Matti Nurmio, both of Turku, Finland

[73] Assignee: Valmet Oy, Finland

[21] Appl. No.: 328,793

[22] Filed: Dec. 8, 1981

[30] Foreign Application Priority Data

Dec. 12, 1980 [FI] Finland ..... 803891

[51] Int. Cl.[3] ..... F26B 3/04; F26B 13/08

[52] U.S. Cl. ..... 34/23; 34/34; 34/114; 34/117

[58] Field of Search ..... 34/113, 114, 116, 117, 34/123, 155, 159, 122, 23, 34

[56] References Cited

U.S. PATENT DOCUMENTS

| | | | |
|---|---|---|---|
| 1,595,478 | 8/1926 | Minton | 34/117 |
| 3,733,711 | 5/1973 | Haythornthwaite | 34/155 |
| 4,185,399 | 1/1980 | Gladish | 34/114 |
| 4,202,113 | 5/1980 | Kankaanpaa | 34/116 |
| 4,263,724 | 4/1981 | Vits | 34/114 |
| 4,359,828 | 11/1982 | Thomas | 34/114 |
| 4,416,070 | 11/1983 | Vedenpa et al. | 34/116 |

FOREIGN PATENT DOCUMENTS 803721 12/1980 Finland .

*Primary Examiner*—Larry I. Schwartz

*Attorney, Agent, or Firm*—Steinberg & Raskin

[57] ABSTRACT

The surfaces of cylinders or fabrics moving in the press or drying section of a paper machine induce layers of air along with them, which layers of air produce positive and negative pressures at the pits or nips defined by the fabrics or web and the surface of the cylinder. The positive and negative pressures are detrimental to the mutual support contact between the web and the fabric. A method for eliminating the detrimental positive and negative pressures affects the pressure levels at the nips by blowing air in directions opposite to the direction of travel of the web or fabric passing close to a blowing device, and possibly also opposite to the direction of travel of the cylinder surface. As a result of the blowing of air, air is ejected from the pressurized nips or from spaces placed facing the nips of negative pressure on the opposite side of the running of the web and the fabric. Apparatus for carrying out the method includes a blow box placed in connection with the nip. The blow box is connected to devices producing pressurized air and is provided with one or several nozzle slots. A nozzle slot has a curved nozzle surface at an angle of curvature of about 30° to 70°. The direction of the jets of air blown out of the nozzle slots is turned via the nozzle surface due to the Coanda effect. A planar surface follows the curved nozzle surface and functions as a carrying surface stabilizing the web or fabric.

20 Claims, 8 Drawing Figures

METHOD AND APPARATUS FOR THE DRYING SECTION OF A PAPER MACHINE

BACKGROUND OF THE INVENTION

The present invention relates to a method and apparatus for the drying section of a paper machine. More particularly, the invention relates to a method used in the press or drying section of a paper machine to prevent the formation of positive and negative pressures, detrimental to the support contact between the web and the fabric, at pits or nips defined by the fabric or web and the surface of the cylinder.

The invention also relates to apparatus for carrying out the method of the invention, which includes a blow or blowing box in operative proximity with the nip and extending substantially over the entire width of the web. The blow box is connected to apparatus producing blowing air and is provided with one or a plurality of nozzle slots.

It is well known that a thin layer of air follows all moving surfaces. No gliding occurs between the air and a moving surface, but particles of air which contact the moving surface travel at the same speed as said surface.

The pit defined by the fabric such as, for example, felt, or wire screen, and the surface of the cylinder or roller is called the inlet nip when said fabric enters said pit, and the outlet nip when the fabric leaves said pit.

If all the limiting surfaces of the nip are impenetrable to air, flows of air are produced between the limiting layers both at the inlet nip and at the outlet nip, the directions of flow being opposite in relation to said layers. Thus, due to the damming of the flows at the limiting layers, there is a positive pressure at the inlet nip across the fabric, and, due to the suction effect of the flows at said limiting layers, there is a negative pressure at the outlet nip across the fabric.

When fabrics penetrable to air such as, for example, wire screens, are used in a previously known manner, the pressure differences produced by the flows at the limiting layers across the wire screen produce flows of air through said wire screen.

Several prior art pocket ventilation apparatus of paper machines are based on the pumping effect of open drying screens.

As is well known, the first and the second drying groups of a paper machine are usually provided with a so-called single-fabric guide system, which is frequently accomplished so that at the upper cylinders the paper web is between the fabric and the cylinder, and at the lower cylinders, said web is on said fabric.

The single-fabric guide system has several problems resulting from pressure differences on different sides of the fabric, caused by the flows at the limiting layers. The air tends to flow from a higher pressure area to a lower pressure area through the wire screen, and thereby to interrupt the support contact between the fabric and the paper web. The problematic points are the outlet nip and the inlet nip. At both points, the pressure difference across the wire screen tends to detach the paper web from the wire screen. After the paper web and the wire screen are detached, the web begins to behave in an unstable manner, due to flows of air occurring in the pocket. The detached web is frequently extended at the lower cylinders due to the effect of centrifugal force. The consequences are serious wrinkles at the inlet nip and, in the worst case, breakage of the web.

In order to solve the aforementioned problems, various seal constructions have been developed, whose objective is to prevent the entrance of the boundary-layer flows following the moving surface into the nip. Patent application No. DE-OS 2,712,184, for example, discloses a sealing construction for this purpose.

Finnish patent application No. 771056 discloses a method for the drying section of a paper machine for passing the web in a sealed guide system, in which method, a drying fabric or screen is used in the initial part of the drying section, especially in its first group of drying cylinders. The drying fabric or screen is positioned or arranged in a manner whereby the cylinders in one row are outside the loop of the fabric and the other cylinders are inside said loop, so that the web runs, making bends from one cylinder row to the other, all the time, as supported by the same fabric from the beginning to the end of the group of drying cylinders provided with that fabric. In this application, it is considered a novelty that a pressure difference is applied to the web at least at some of the cylinders of the row within whose sector the web is outside the fabric. The pressure difference is applied to the web via the hollow surfaces of the cylinders, so that the pressure prevailing outside the web is greater than the pressure prevailing in the cavities of the hollow surface. The purpose of this is to especially prevent the web from being detached from the fabric and to insure constant operation of the paper machine.

Finnish Pat. No. 54,954 discloses a method for insuring the transfer of the web from the press section to the drying section. In the method of the Finnish patent, the principal novelty is that a separate guiding drying cylinder, actually not belonging to such group, is provided between the group of drying cylinders and the press section. In order to keep the web in contact with the lower drying belt when said lower drying belt circulates around the upper cylinders of the particular cylinder group, an upper drying belt, of a width substantially equal to the width of the web, is passed onto the web in order to press the web against the lower drying belt within a sector substantially smaller than the sector within which the lower drying belt supporting the web covers the upper cylinders. The upper drying belt may be brought into contact with the guiding drying cylinder by an adjustably positioned guiding roller, at least at the stage in which the web is transferred from the press section to the drying section when the paper machine is being started.

Furthermore, with regard to the state of technology related to the invention, reference is made to Finnish patent application No. 793643 of the inventor, which patent discloses apparatus in the drying section of a paper machine for passing the web in a sealed guide system. A drying fabric of the apparatus is arranged or positioned in a manner whereby one or some of the cylinders or rollers of the drying section are placed outside the loop of the drying fabric and the other cylinder or roller, or cylinders or rollers, are placed inside said loop, so that the web passes from one cylinder or roller to another, supported by the fabric throughout the distance between cylinders or rollers. The apparatus comprises a suction box or suction boxes fitted to act on the drying fabric. In this application, it is considered a novelty that the suction box is, or the suction boxes are fitted to extend substantially over the entire length of the common run of the web and the drying fabric from one cylinder or roller to another. The suction of the suction box extends into the wedge space between the drying fabric and the drying cylinder or roller mantle, at least at the inlet side of the drying fabric and the web.

The prior art mechanical seals are limited, since they cannot be brought close enough to the moving web or fabric, due to the risk of damage to the web and wear of the fabric. It is impossible to seal an outlet nip by mechanical means, for example, since the moving paper web requires a distance of at least 10 mm from the seal. At an inlet nip, it is theoretically possible to place the seal closer to the fabric, but the problem point is then shifted to ahead of the seal, where a positive pressure caused by the dam pressure of the flow at the limiting layer is formed.

The efficiency of mechanical seals is also reduced with time, if the seals are placed so close to the moving surfaces that abrasion occurs.

SUMMARY OF THE INVENTION

The principal object of the invention is to provide a method and apparatus for the drying section of a paper machine for preventing the formation of detrimental positive or negative pressures at the nips.

An object of the invention is to provide a method and apparatus for the drying section of a paper machine, which method and apparatus are not sensitive to wear and do not cause damage to the moving paper web or fabric.

In order to attain these objects and in accordance with the method of the invention, the pressure level of the nip is affected to prevent or reduce pressure differences by blowing air in directions opposite to the direction of travel of the web or fabric passing close to a blowing device and possibly also opposite to the direction of travel of the cylinder surface. As a result of the blowing of air, air is ejected from the pressurized nips or from spaces placed facing the nips of negative pressure on the opposite side of the running of the web and the fabric.

In accordance with the invention, apparatus for carrying out the method comprises a nozzle slot, having a curved nozzle surface having an angle of curvature of about 30° to 70°. The direction of the jets of the air blown out of the nozzle slots is turned via the nozzle surface due to the Coanda effect. A substantially planar surface follows the curved nozzle surface and functions as a carrying surface stabilizing the web or fabric.

BRIEF DESCRIPTION OF THE DRAWINGS

For a fuller understanding of the invention, reference is had to the following description, taken in connection with the accompanying drawings, in which.

DESCRIPTION OF PREFERRED EMBODIMENTS

Figure 1:
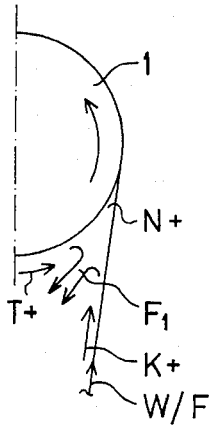
FIG. 1 is a schematic diagram illustrating the formation of a positive pressure in a pit defined by the surface of a cylinder and the web and fabric, in the drying section of a paper machine.

As shown in FIG. 1, a fabric and web combination W/F comes onto the cylinder 1, whereby the surface of the cylinder and said combination W/F define a narrowing pit N+ between them due to the effect of the flows T+ and K+ at the boundary layers. The positive pressure formed in the pit N+ in this manner tends to be discharged as flows $F_1$.

Figure 2:
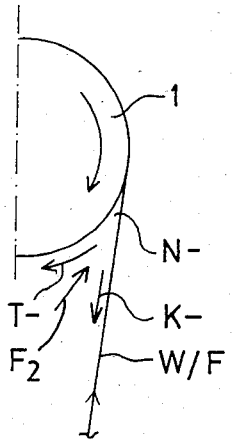
FIG. 2 is a schematic diagram illustrating the formation of negative pressure in a pit, in a manner corresponding to that of FIG. 1.

As shown in FIG. 2, the fabric and web combination W/F leaving the cylinder 1 produces a boundary layer flow K−, which together with the boundary layer flow T− of said cylinder, produces a negative pressure in the nip N−. The negative pressure N− tends to be filled as a flow $F_2$.

Figure 3:
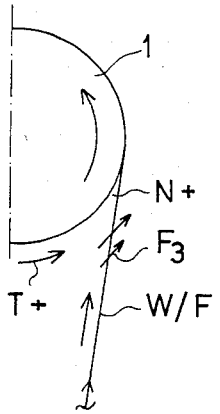
FIG. 3 is a schematic diagram illustrating the flows of air through a wire screen, produced by positive pressure, when the web and fabric is penetrable to air.
Figure 4:
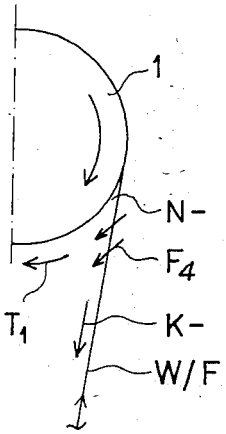
FIG. 4 is a schematic diagram illustrating the flows of air through a wire screen, produced by negative pressure, when the web and fabric is penetrable to air, in a manner corresponding to FIG. 3.

In the situations shown in FIGS. 1 and 2, the fabrics F are impenetrable to air. On the other hand, in FIGS. 3 and 4 fabrics or wire screens F are penetrable to air. In FIGS. 3 and 4, the mechanism of formation of the nips N+ with positive pressure is similar to that of FIG. 1. However, as shown in FIG. 3, the positive pressure at the nip N+ tends to be discharged as a flow $F_3$ through the fabric and web combination W/F. In a corresponding manner, as shown in FIG. 4, flows are produced at the nip $N_1$ with negative pressure through the fabric and the web W/F. Such flows are illustrated in FIG. 4 by arrows $F_4$.

Figure 5:
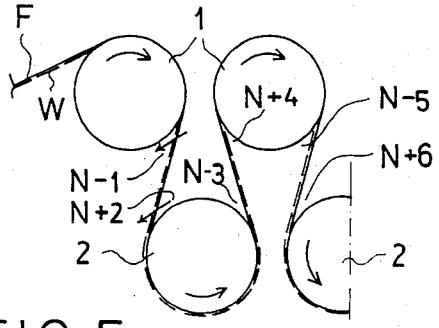
FIG. 5 is a schematic diagram illustrating a portion of a multicylinder drying section of a paper machine, having a single-fabric guide system, illustrating the positions of the nips with positive and negative pressures.

In the portion of a multicylinder drying section shown in FIG. 5, the web W passes between an upper cylinder 1 and a lower cylinder 2 as supported by the fabric F. Pits with negative pressure and with positive pressure are alternately produced at the points of contact between the free surfaces of the cylinders 1 and 2 and the web and fabric combination W/F. Such pits constitute nips N−1, N+2, N−3, N+4, N−5 and N+6. As hereinbefore ascertained, the most problematic points are the nips N−1 and N+2, and the nips N−5 and N+6, at which the pressure difference across the fabric F tends to detach the paper web W from said fabric F. At its worst, this results in breakage of the web, as hereinbefore ascertained.

Figure 6:
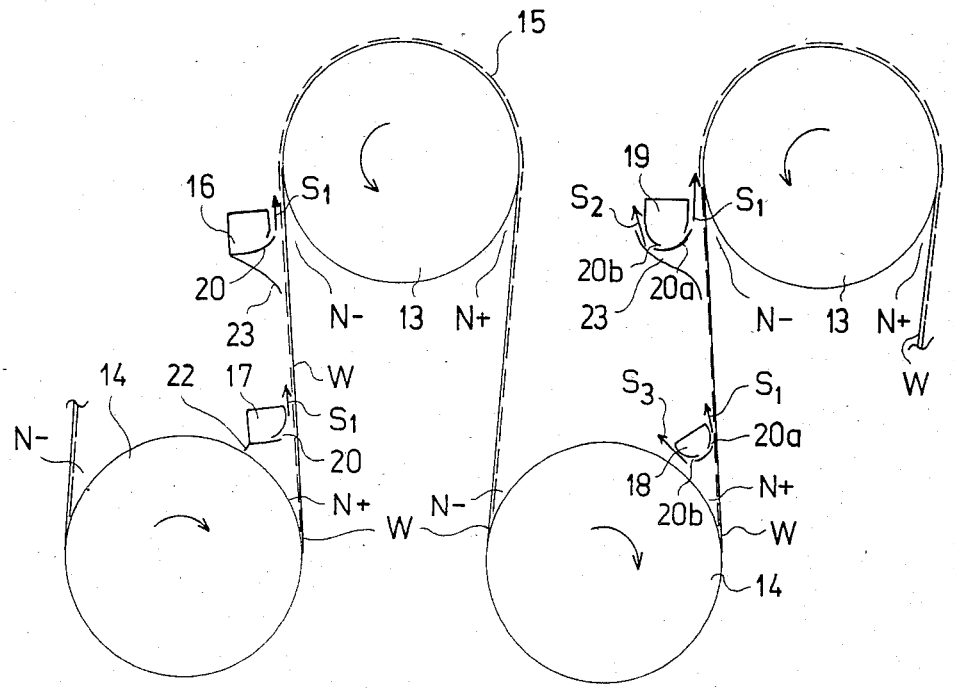
FIG. 6 is a schematic side view of a portion of a multicylinder drying section of a paper machine having a single-fabric guide system, which portion utilizes the method of the invention to adjust the pressure levels of the nips.
Figure 7:
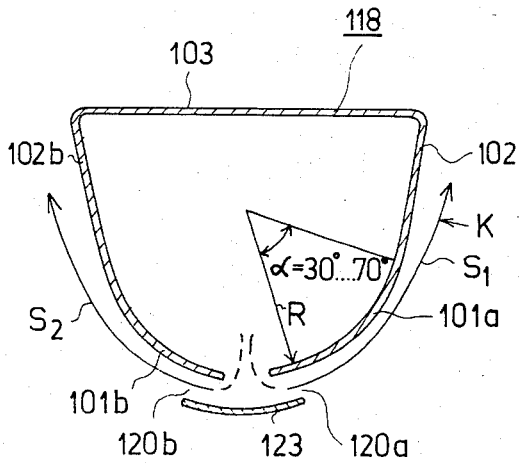
FIG. 7 is a sectional view, on an enlarged scale, of an embodiment of the nozzle box of the invention, provided with two nozzle slots.
Figure 8:
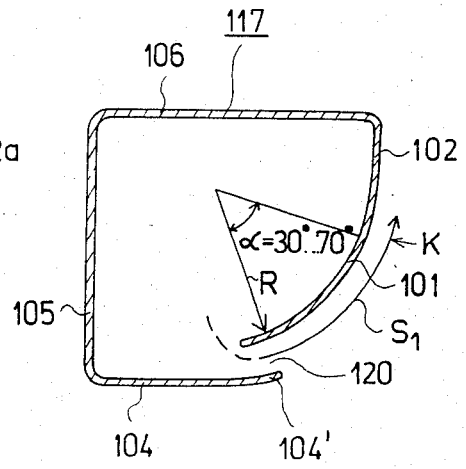
FIG. 8 is a sectional view, on an enlarged scale, of an embodiment of the nozzle box of the invention, provided with one nozzle slot.

FIGS. 6, 7 and 8 show the apparatus of the invention for solving the aforementioned problems. A multicylinder drying section shown in FIG. 6 comprises a row of upper cylinders 13 and a row of lower cylinders 14. The upper cylinders 13 and the lower cylinders 14 are placed in interlocking relationship with each other. A wire screen 15 passes from the upper cylinder 13 to the next lower cylinder 14, and vice versa, making bends. The web W is on the upper cylinder 13 between the wire screen 15 and said cylinder. However, the web W is on the wire screen 15 on the lower cylinder 14.

The free surfaces of the drying cylinders 13 and 14, the wire screen 15, and the web W define pits or nips N, in which positive pressure N+ or negative pressure N− is formed, depending upon the direction of movement. In order to eliminate detrimental positive or negative pressure, blow boxes 16, 17, 18 and 19 of the invention are placed in operative proximity with the nips. Air jets are blown out of the blow boxes 16 to 19 in a specific manner, in order to eliminate the detrimental pressure difference which tends to detach the web W from the fabric or wire screen 15.

One side of the blow box 17 is provided with one nozzle slot 20 and is, in the manner shown in FIG. 6, sealed against the surface of the cylinder 14 via a mechanical sealing member 22.

The jets of air discharged from the nozzle slot 20 facing the web W and the wire screen 15 are turned due to the Coanda effect, so that the direction of the jet $S_1$ is opposite to the direction of movement of said web and said wire screen. This is an essential feature of the method and apparatus of the invention.

The blow box 19 is provided with two nozzle slots 20*a* and 20*b* and is placed in operative proximity with the upper cylinder 13. The blow box 19 is turned so that it is parallel with an auxiliary plate 23 placed alongside said blow box. The jet of air $S_2$ discharged from the nozzle slot 20*b* is directed away from the wire screen 15. The auxiliary plate 23 functions to intensify the ejection effect of the jets $S_1$ and $S_2$.

The pressure levels at the nips N+ and N− are changed due to the ejection effect of the air jets $S_1$ discharged from the nozzles 20, 20*a* and 20*b*. The desired pressure level is obtained in the nip by adjusting the quantity of air in the blow box 16 to 19. In a measured test, the nip originally had a positive pressure of 2 to 5 Pa. The blow box of the invention provided a negative pressure of up to 700 Pa at the nip. Any pressure whatsoever, between the aforementioned pressure, may be produced at the nips N+ and N− by changing the quantity of air in the blow box 16 to 19.

As hereinbefore described, the blow boxes 16, 17, 18 and 19 are placed in operative proximity with the nips N+ and N− at which the pressure difference tends to detach the web W from the fabric 15. The blow boxes 17 and 18 are placed in operative proximity with the nips N+ with positive pressure and eject air from said nips with positive pressure via their air jets $S_1$ and $S_3$. The blow boxes 16 and 19 are placed in operative proximity with the nips N− with negative pressure, at the opposite side of the web W and the wire screen 15 relative to the nip N+. The air jets $S_1$ of the blow boxes 16 and 19 produce a vacuum effect in a known manner, and said vacuum effect compensates for the negative pressure prevailing at this point at the opposite side of the wire and the web at the nip N−, so that a detrimentally large pressure difference cannot be created.

Auxiliary plates 23 are provided at the blow boxes 16 and 19. The plates 23 confine to the boxes spaces that are limited on one side by the common run of the wire screen 15 and the web W. The air jets $S_1$ and $S_2$ eject air from the spaces, so that the negative pressure produced in said spaces is substantially equal to the negative pressure prevailing at the opposite side of the web and the wire screen at the nip N−. Furthermore, a negative pressure is produced at the surface after the nozzle slots 20 and 20*a* of the blow boxes, due to the effect of the flows $S_1$. Due to such negative pressure, the web W and the wire screen assume a specific position of equilibrium.

FIGS. 7 and 8 are cross-sectional views of two exemplifying embodiments of the blow box of the invention. Blow boxes 117 and 118, shown in FIGS. 8 and 7, respectively, preferably extend over the entire width of the web, and the air is introduced into said boxes either from both ends of each box or from one end of each box.

As shown in FIG. 7, the blow box 118 comprises two blowing slots 120*a* and 120*b*. The blow box 118 is symmetrical relative to a vertical center plane. The blowing slots or nozzles 120*a* and 120*b* are restricted between the auxiliary plate 123 and curved walls or surfaces 101*a* and 101*b* of the blow box. The walls or surfaces 101*a* and 101*b* are curved, in the shape of an arc R of a circle at an angle $\alpha$ equal to approximately 30° to 70°, for example, after the mouth openings of the blowing slots 120*a* and 120*b*. Afterward, from point K onwards, the walls 102*a* and 102*b* are substantially planar and are interconnected by a substantially planar upper wall 103. Due to the Coanda effect, the air jets blown out of the nozzle slots 120*a* and 120*b* follow the curved surfaces 101*a* and 101*b* up to an angle of approximately 70°.

As shown in FIG. 8, the blow box 117 comprises one blowing slot 120, which is confined to the space between an edge 104' of a wall or surface 104 and a curved wall or surface 101. The curved guide surface 101, whose curve radius is R, at an angle $\alpha$ equal to approximately 30° to 70°, is provided after the mouth opening of the nozzle or blowing slot 120. Afterward, a planar wall 102 begins from point K. The nozzle blow box 117 has substantially planar walls or surfaces 105 and 106.

The method of the invention involves no problem of rubbing of the wire screen or the web, and consequently does not cause wearing to occur, either. This is due to the fact that the nozzle of the invention is a so-called foil nozzle, which is characterized by the surface positioned against the carrying surface, which is the wire screen or the web, assuming a so-called position of equilibrium in relation to said carrying surface, due to the flow of air blown. There is always a space of a few millimeters between the carrying surface of the nozzle and the wire screen or web. Since the surface of the nozzle is shaped so that the jet is turned by at least approximately 30° from its original direction, the portion of the carrying surface of the nozzle lying against the wire screen or the web is curved without any sharp edges.

The invention is by no means restricted to the aforementioned details which are described only as examples; they may vary within the framework of the invention, as defined in the following claims.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A method for preventing separation of a running web from a supporting fabric due to formation of positive pressure in a drying section of a paper machine, at a nip defined by a joint run of the web and fabric and a surface of a cylinder within the drying section, said method comprising the step of blowing air in a direction substantially opposite to the direction of travel of the joint run, and on said fabric to reduce a pressure difference by ejecting air from the positive pressure nip in which the pressure tends to detach the web from the fabric.

2. A method as claimed in claim 1, further comprising the step of blowing air opposite to the direction of rotation of the cylinder.

3. A method as claimed in claim 1, further comprising the step of blowing air in a positive pressure nip in a first direction substantially parallel to said fabric and opposite to the direction of movement of said fabric and in a second direction substantially parallel to the surface of the cylinder defining said nip and opposite to the direction of rotation of said cylinder.

4. A method as claimed in claim 1, wherein said web and said fabric are moved from the cylinder to an adjoining cylinder and further comprising the step of limiting a space at a positive pressure nip toward the surface of the adjoining cylinder.

5. A method as claimed in claim 1, further comprising the steps of limiting a space adjacent a negative pressure nip at the side of the joint run defining said nip, opposite said nip, and producing a negative pressure in said space.

6. A method as claimed in claim 5, further comprising the step of ejecting air from said limited space.

7. A method as claimed in claim 5, further comprising the steps of blowing air in a first direction opposite the direction of movement of said fabric and ejecting air from said limited space in a second direction, different from said first.

8. Apparatus for preventing separation of a running web from a supporting fabric due to the formation of positive pressure in a drying section of a paper machine, in a nip defined by a joint run of the web and fabric and a surface of a cylinder within the drying section, said apparatus comprising blowing means situated in operative proximity with the positive pressure nip in which a pressure difference tends to detach the web from the fabric, for blowing air on the fabric in a direction substantially opposite to the direction of travel of the joint run passing close to said blowing means, to reduce the pressure difference by ejecting air from the positive pressure nip.

9. The method of claim 8 wherein the drying section constitutes a multicylinder drying section comprising at least one upper cylinder and at least one lower cylinder, and said cylinder forming the positive pressure nip is a lower cylinder thereof.

10. A method as claimed in claim 9, further comprising the step of directing a flow of air adjacent the joint run to provide a pressure effect which stabilizes said adjoining web and fabric to a specific position of equilibrium.

11. Apparatus as claimed in claim 8, wherein said blowing means blows air opposite to the direction of rotation of the cylinder.

12. Apparatus as claimed in claim 8, wherein said blowing means has a first side for blowing air in a positive pressure nip in a first direction substantially parallel to said fabric and opposite to the direction of movement of said fabric and a second side for blowing air in a second direction substantially parallel to the surface of the cylinder defining said nip and opposite to the direction of rotation of said cylinder.

13. Apparatus as claimed in claim 10, wherein said apparatus includes an adjoining cylinder and said web and said fabric are moved from the cylinder to said adjoining cylinder and further comprising a sealing member extending toward the surface of said adjoining cylinder and limiting a space at a positive pressure nip toward said surface.

14. Apparatus as claimed in claim 1, further comprising an auxiliary wall limiting a space adjacent a negative pressure nip in conjunction with said blowing means at the side of the joint run defining said nip, opposite said nip, said blowing means producing a negative pressure in said space.

15. Apparatus as claimed in claim 8, wherein said blowing means comprise foil nozzles having a carrying surface in operative proximity with the joint run, said carrying surface directing a flow of air adjacent the joint run to provide a pressure effect which stabilizes said adjoining web and fabric to a specific position of equilibrium relative to said carrying surface.

16. Apparatus as claimed in claim 14, wherein said blowing means includes means for producing an air jet for ejecting air from the space limited by said auxiliary wall.

17. Apparatus as claimed in claim 14, wherein said blowing means includes means for producing a first air jet in a first direction from one side of said blowing means opposite the direction of movement of said fabric and means for producing a second air jet in a second direction from another side of said blowing means to eject air from the space limited by said auxiliary wall.

18. Apparatus as claimed in claim 15, wherein said blowing means comprises a blow box in operative proximity with a nip and extending substantially over the entire width of said web, and having at least one nozzle slot, a curved nozzle surface at said nozzle slot having an angle of curvature of approximately 30 to 70 degrees for turning the direction of air jets blown from said nozzle slot by the Coanda effect and a substantially planar surface after said curved nozzle surface and functioning as said carrying surface.

19. Apparatus as claimed in claim 16, wherein said blow box is substantially symmetrical about a center plane and has two nozzle slots blowing air jets in opposite directions, a curved nozzle surface at each of said nozzle slots having an angle of curvature of approximately 30 to 70 degrees for turning the direction of air jets blown from said nozzle slots by the Coanda effect, a substantially planar surface after said curved nozzle surfaces and functioning as said carrying surface and an auxiliary plate at said curved nozzle surfaces for restricting said nozzle slots.

20. The apparatus of claim 8 in which the drying section constitutes a multicylinder drying section comprising at least one upper cylinder and at least one lower cylinder, and said cylinder forming said positive pressure nip is a lower cylinder thereof.

* * * * *

UNITED STATES PATENT AND TRADEMARK OFFICE

CERTIFICATE OF CORRECTION

PATENT NO. : 4,516,330

DATED : May 14, 1985

INVENTOR(S) : Pekka Eskelinen et al.

It is certified that error appears in the above-identified patent and that said Letters Patent is hereby corrected as shown below: Title page:

In the Abstract:

Line 15, delete "placed";

In the Specification:

Column 3, line 39, delete "placed";

In the Claims:

Claim 9, line 1, change "8" to --1--.

Claim 10, line 1, change "9" to --1--.

Claim 13, line 1, change "10" to --8--.

Claim 14, line 1, change "1" to --8--.

Signed and Sealed this

Twenty-fourth Day of January, 1989

*Attest:*

DONALD J. QUIGG

*Attesting Officer*

*Commissioner of Patents and Trademarks*